US012679432B1

(12) United States Patent
Poisler

(10) Patent No.: US 12,679,432 B1
(45) Date of Patent: Jul. 14, 2026

(54) SYSTEM AND METHOD TO PREDICT CLEARANCE WHEN TRANSPORTING EQUIPMENT ON RAILWAY

(71) Applicant: UTC Overseas, Inc., Houston, TX (US)

(72) Inventor: Marco A Poisler, Houston, TX (US)

(73) Assignee: UTC OVERSEAS, INC., Houston, TX (US)

( * ) Notice: Subject to any disclaimer, the term of this patent is extended or adjusted under 35 U.S.C. 154(b) by 0 days.

(21) Appl. No.: 19/086,572

(22) Filed: Mar. 21, 2025

Related U.S. Application Data

(63) Continuation of application No. 18/970,468, filed on Dec. 5, 2024, now Pat. No. 12,296,878.

(60) Provisional application No. 63/709,301, filed on Oct. 18, 2024.

(51) Int. Cl.
*B61L 27/70* (2022.01)
*B61L 27/57* (2022.01)

(52) U.S. Cl.
CPC ..... *B61L 27/70* (2022.01); *B61L 27/57* (2022.01)

(58) Field of Classification Search
CPC ..... B61L 27/57; B61L 27/70
USPC ..... 701/19
See application file for complete search history.

(56) References Cited

U.S. PATENT DOCUMENTS

2013/0103305 A1* 4/2013 Becker ..... G01C 21/3453 701/410
2019/0056736 A1* 2/2019 Wood ..... G05D 1/0246

OTHER PUBLICATIONS

American Public Transportation Association. "Developing a Clearance Diagram forPassenger Equipment," first published Mar. 26, 1998, 25-pgs.
Duval, B., "Railroad Clearances: Evolution in our Industry," PowerPoint presentation, dated Jul. 9, 2019, 34-pgs.
Ensco Rail, Inc., "Track Inspection Products & Services." Booklet, downloaded from www.ensco.com/sites/default/files/2024-09/ENSCO-Track-Inspection-Products-Services-Booklet-9057-2024_0.pdf, dated Sep. 2024, 48-pgs.

* cited by examiner

*Primary Examiner* — Adam D Tissot
(74) *Attorney, Agent, or Firm* — Cabello Hall Zinda PLLC

(57) ABSTRACT

The method involves obtaining input data that includes: (i) railway mapping data, (ii) clearance data for the railways, (iii) schematic (preferably image) data related to the load being transported, and (iv) the transport's origin and destination. Using this data, one or more artificial intelligence (AI) models determine dimensional parameters of the load by processing the schematic image. A transport envelope for the load is defined based on these parameters. The railways connecting the origin and destination are identified, the probability of the transport envelope clearing clearance data on those railways is determined. Based on these probabilities, at least one viable route is determined across the railways connecting the origin to the destination.

25 Claims, 9 Drawing Sheets

SYSTEM AND METHOD TO PREDICT CLEARANCE WHEN TRANSPORTING EQUIPMENT ON RAILWAY

CROSS-REFERENCE TO RELATED APPLICATIONS

This application is a continuation of U.S. Non-Provisional application Ser. No. 18/970,468 filed Dec. 5, 2024, which claims the benefit of U.S. Provisional Appl. No. 63/709,301 filed Oct. 18, 2024, which is incorporated herein by reference in its entirety.

BACKGROUND OF THE DISCLOSURE

Transporting large equipment by rail can be challenging because there can be many physical structures and other obstacles on the railway that need to be cleared. Additionally, the route needed to transport the large equipment from a staring location to a final destination may need to pass along many railway lines and different jurisdictions, each having different standards and requirements. The current procedures to determine the route for the transport and to determine if there is sufficient clearance available for the transport can be time-consuming and cumbersome. What is needed is a more automated and optimized process of obtaining rail clearance for transporting large equipment (e.g., transformers, boilers, power generators) via railway.

SUMMARY OF THE DISCLOSURE

In one configuration disclosed herein, a computer system can process manufacturer drawings and user inputs to determine rail clearance feasibility and to determine optimal loading configurations. To do this, the computer system integrates historical clearance data with real-time manufacturer specifications and performs predictive modeling to assess clearance, predict clearance probabilities, and suggest appropriate railcar types if necessary. Finally, the computer system generates an output of the results. For example, for rail transportation, the computer system can generate a railroad clearance file, which can include details and disclaimers comparable to those produced in the rail industry.

As disclosed herein, the computer system streamlines the clearance process for oversized rail shipments. Using this computer system, operators can reduce time and cost in obtaining clearances and can improve accuracy in predicting clearance issues. Finally, operators can use the computer system to optimize loading configurations for specialized equipment.

One configuration of the present disclosure includes a computer-implemented method. Input data is obtained with one or more interfaces in a computing environment. The input data at least includes (i) mapping data associated with one or more railway routes, (ii) clearance data associated with the one or more railway routes, and (iii) schematic data at least associated with a load to be transported on a railcar. In the method, one or more artificial intelligence models are operated on one or more processors in the computing environment.

Dimensional parameters associated with the load carried on the railcar are determined by processing the schematic data of at least the load, and a transport envelope of the load carried on the railcar is defined based on the dimensional parameters. One or more metrics are determined that characterize the transport envelope of the load carried on the railcar clearing the clearance data on the one or more railway routes. Based on the one or more metrics, at least one recommendation is determined for the transport envelope of the load carried on the railcar to clear the historical clearance data on the one or more railway routes.

Another configuration of the present disclosure includes a non-transitory machine-readable medium, on which are stored instructions for a machine, comprising instructions that when executed cause the machine to obtain the input data and to operate one or more artificial intelligence models as described above.

Yet another configuration of the present disclosure includes a system comprising: one or more databases storing mapping data for railway routes and storing clearance data for the railways; one or more interfaces being configured to obtain the input data; and one or more processors operatively couped to the one or more databases and the one or more interface and configured to operate the one or more artificial intelligence models as described above.

The foregoing summary is not intended to summarize each potential configuration or every aspect of the present disclosure.

DETAILED DESCRIPTION OF THE DISCLOSURE

Figure 1:
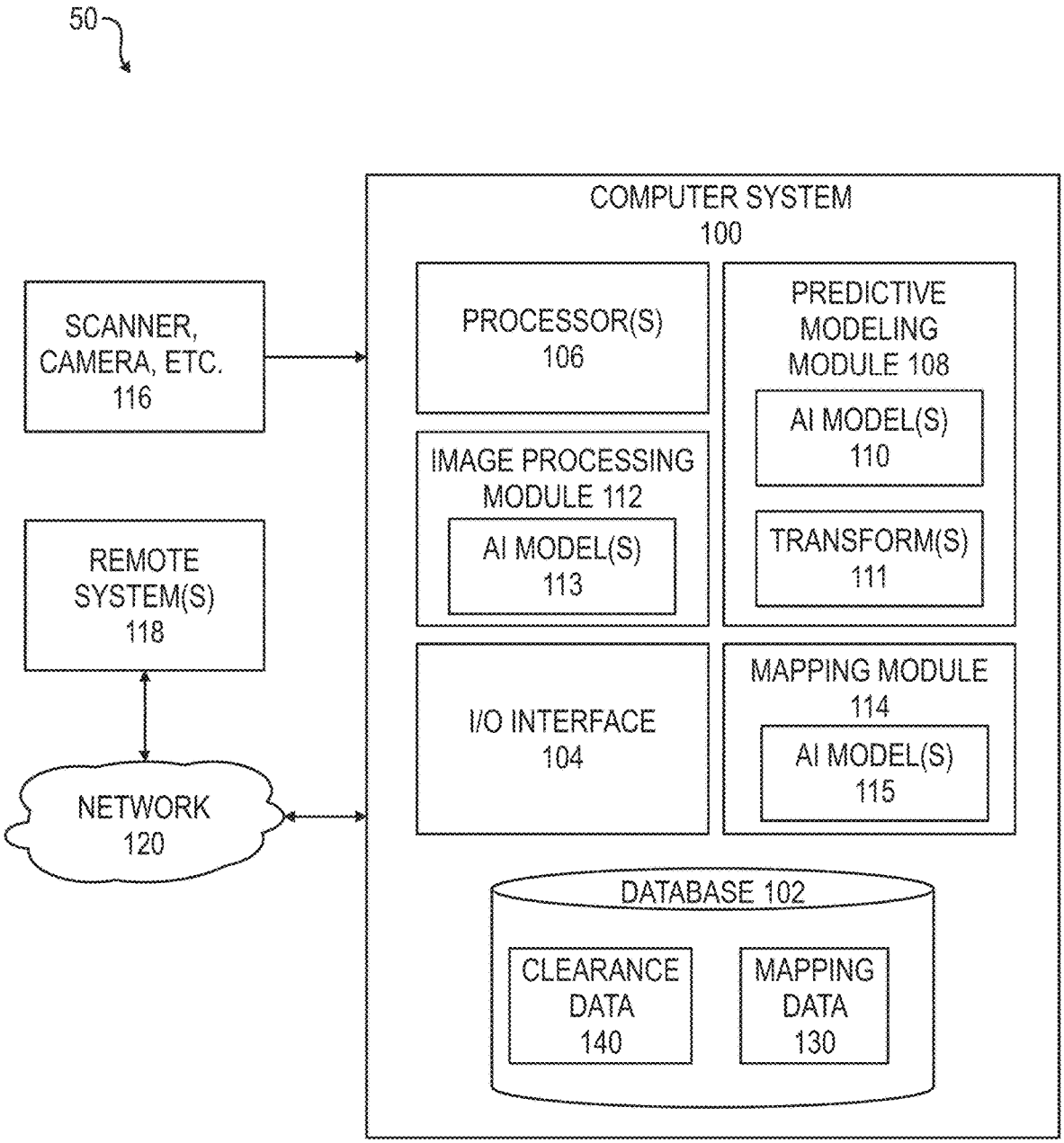
FIG. 1 schematically illustrates a computer system for determining a transportation route (e.g., railway route) and obtaining a clearance report to transport a load (e.g., transformer, boiler, pressure vessel, power generator, or other large equipment).

FIG. 1 schematically illustrates a computing environment 50 for determining a transportation route (e.g., railway route) and obtaining a clearance report to transport a load (e.g., transformer, boiler, pressure vessel, power generator, industrial machinery, construction equipment, energy equipment, or other large equipment). The computer environment 50 can include different components including, but not limited to, a computer system 100, a database 102, interfaces 104, and a processor 106. Each of these can be comprised of one or more components. The processor 106 is operatively coupled to the database 102 and the interfaces 104.

The computing environment 50 may take different forms. For example, the computer system 100 can be a tablet, a desktop, a laptop, a mobile device, a cloud device, or a standalone device. The computing environment 50 can also be a distributed system that includes one or more connected computing components/devices that are in communication with the computer system. The processor 106 can be, without limitation, different types of hardware logic components/processors, including Field-Programmable Gate Arrays (FPGA), Program-Specific or Application-Specific Integrated Circuits (ASIC), Application-Specific Standard Products (ASSP), System-On-A-Chip Systems (SOC), Complex Programmable Logic Devices (CPLD), Central Processing Units (CPU), Graphical Processing Units (GPU), or any other type of programmable hardware.

Storage provided by the database 102 may be physical system memory, which may be volatile, nonvolatile, or some combination of the two. The term "memory" may also be used herein to refer to nonvolatile mass storage such as physical storage media. If the computer system is distributed, the processing, memory, and/or storage capability may also be distributed. Storage can also include executable instructions (such as code) and data. The code can represent instructions that are executable by one or more processors of the computer system to perform operations.

The I/O interfaces 104 include any type of input or output device. Such devices include, but are not limited to, touch screens, displays, a mouse, a keyboard, a controller, and so forth.

The computer system 100 can communicate over one or more networks 120 with any number of devices or cloud services to obtain or process data in the computing environment 50. The I/O interfaces 104 can therefore include any appropriate network interfaces. In some cases, the one or more networks 120 may be a cloud network. Furthermore, the computer system 100 may also be connected through one or more wired or wireless networks 120 to one or more remote or separate system(s) 118 that are configured to perform any of the processing described in the computing environment 50. The remote systems 118 can include a third-party service that provides artificial intelligence processing, machine learning, and other capabilities, which may be shared with the computer system 100 or may be provided independently.

The remote systems 118 can also include computer systems, databases, and other information sources of railroads (Class 1 and shoreline railroads) or other third-party service providers that have clearance information, route information, schematics of different railroad cars, and other data relevant to the determinations and calculations disclosed herein for clearance. For example, the remote systems 118 can include clearance measurements from laser scans along rail, measurements of track center along rail, details of critical points (such as bridges, structures, foliage, etc.), successful movement records, and the like.

The computer environment 50 has functional modules for processing input data and for producing output data according to the present disclosure. In particular, the computer environment 50 has one or more artificial intelligence (AI) models, which can be executed on the computer system 100, executed on one or more remote systems 118 and at least utilized by the computer system 100, or both. A first AI model can be trained to determine dimensions from image data and to calculate envelopes from the dimensions. A second model can be trained to find optimal paths along railways, and a third model cane trained to predict clearance based on an analysis of the clearance data, the envelopes, and the optimal paths.

As shown in the example of FIG. 1, the computer system 100 includes a predictive modeling module 108, an image processing module 112, and a mapping module 114. As will be appreciated, the algorithms, data structures, and system architecture of the computer system 100 are only schematically shown in FIG. 1. As will also be appreciated, any of the modules (108, 112, 114) of the computer system 100 can be provided remotely and independently by any of the one or more the remote systems 118. Therefore, in the discussion below, reference to processing performed by the computer system 100 can apply equally to processing performed by any of the one or more remote systems 118 as well.

Looking first at image processing, the image processing module 112 uses one or more AI models 113 trained by machine learning algorithms to learn from image data, determine dimensions from the image data, and calculate envelopes from the dimensions. These one or more AI models 113 of the image processing module 112 can be implemented using appropriate forms of artificial intelligence, such as a deep neural network (DNN), convoluted neural network (CNN), large language model (LLM), and the like.

The image processing module 112 is configured to process image data within a computer-generated image file, a captured image, or other type of image source. For example, the image data can be obtained from an image captured using an imaging device 116, such as a scanner, a camera, etc. Alternatively, the image data can be obtained from a computer-generated image file having a suitable format and being stored in the database 102. For instance, the image processing module 112 can integrate with AutoCAD, Portable Document Format (PDF), or other file formats for computer-generated image files and may use the processing technologies associated with the programs for these types of file formats.

Looking next at mapping, the mapping module 114 includes geospatial mapping capabilities for route analysis. The mapping module 114 can use one or more AI models 115 trained by machine learning algorithms to learn from mapping data, determine logistic information, and find optimal paths along railways. These one or more AI models 115 of the mapping module 114 can be implemented using appropriate forms of artificial intelligence, such as a deep neural network (DNN), convoluted neural network (CNN), large language model (LLM), and the like.

The database 102 stores mapping data 130 and historical clearance data 140 for the railways. The database 102 can also store railcar specifications and other appropriate information. The mapping data 130 and the historical clearance data 140 can be obtained from external data sources and remote systems 118, such as transportation agencies (North American Rail Network, Federal Railroad Administration, Association of American Railroads (AAR) Open Top Loading Rules, American Railway Engineering and Maintenance-of-Way Association (AREMA), etc.), railroad companies (BNSF, Union Pacific, Kansas City Southern, CSX, Norfolk Southern, etc.), and the like. Guidelines can also be obtained from sources, such as tie down requirements according to AREMA Committee 28 and the AAR Open Top rules. In this way, physical route clearance of a load on a railcar for a route can be further refined according to a Tie Down clearance or other rules governing the load on the railcar after inspection. The computer system 100 can access these types of guidelines for specific implementations. Due to the amount of data involved and the extent (over 160,000 miles) of the rail network, the underlying storage of the mapping data 130 and the historical data 140 may be remote from the computer system 100, and the computer system 100 may interface with remote systems 118 to obtain discrete amounts of data for processing and predictive analysis for a given project.

Additionally, the computer system 100 can receive information from remote systems 118, such as engineering standards of minimum operating clearances from Class 1 railroads or other sources. The information can include schematic image files or textual guidelines giving minimum clearances values and outlines for through railroad owned structures and facilities, such as structures (poles) supporting wirelines, watering and fueling columns, signs, instrument case, dwarf signals between tracks, switch stands, switch machines, platforms, docks, tunnels, bridges, bridge handrails, cattle guards, railroad shops and servicing facilities, overhead structures, electrified territory, stored material, and the like. These may usually be given in terms of minimum clearance values relative to the centerline of the track. Each railroad, such as Class 1 railroads, may also have guidelines requiring clearances to be increased laterally on each side by a given increment for each degree of curvature in the rail when a structure is situated on the curve.

The mapping data 130 includes the geographical details of interconnected rail networks in one or more geographic areas so routes can be analyzed for transportation of an oversized load on a rail car from an origin to a destination. Other than the route information of the railroad networks, the mapping data 130 can include railroad network nodes, rail yards, intermodal freight facilities, freight stations, grade crossings, mileposts, etc. The mapping data 130 includes information of possible railway paths, including the length of tracks, junctions, and connections between different railways.

The historical clearance data 140 can include laser scans, track center measurements, and spatial measurements of obstacles along railways. These obstacles tend to include manmade structures (tunnels heights, signage, utility poles, signal masts, bridge height clearances, walls, fence, overpass, track center from adjacent tracks, structures, etc.). For example, through-truss bridges have angled wing braces and widths that can limit the size of loads carried on railcars that can pass over the bridge. Even a through-plate girder bridge for rail can present an obstacle for low deck flatcars. The obstacles can also include natural structures (cliff sides, canyon walls, trees, etc.). The clearances for both manmade and natural structures along the rail can change over time due to construction, track shifting, etc. Accordingly, the historical clearance data 140 can be measured and updated over time.

Finally, looking at prediction, the predictive modeling module 108 uses one or more Artificial Intelligence (AI) models 110 as trained artifacts created by machine learning algorithms. (As noted, one or more AI models 110 can be used, but reference may be made to one such model for the purposes of discussion.) The AI model 110 is capable of making predictions, classifications, or decisions based on input data. To do this, the AI model 110 encapsulates learned patterns and uses the learned patterns to solve the image recognition, calculations, predictions, and other determinations disclosed herein. For example, the AI model 110 can predict clearance based on an analysis of the historical clearance data, the envelopes, and the optimal paths. In general, the AI model 110 as disclosed herein can include a neural network (e.g., a deep neural network, a convolutional neural network for image recognition, a Feedforward neural networks used in predictive modeling, etc.), a decision tree, a support vector machine, and the like.

The predictive modeling module 108 can also use one or more transforms 111 to perform data preprocessing to modify raw data into a format suitable for use by the AI model 110. (As noted, one or more transforms 111 can be used, but reference may be made to one such transform for the purposes of discussion.) The transform 110 can scale, normalize, or otherwise optimize the input data for the AI model 110. For example, the transform 111 can convert categorical variables into one vector in a process of hot encoding, and numerical data can be scaled to specific ranges. Therefore, in the machine learning (ML) pipeline of the present disclosure, the transform 111 can prepare input data, and the AI model 110 can perform the tasks associated with the present disclosure.

In particular, the predictive modeling module 108 uses the AI model 110 to perform predictive modeling. To do this, the AI model 110 uses one or more machine learning algorithms to learn from data and make predictions. These one or more machine learning algorithms of the AI model 110 can be implemented using appropriate forms of artificial intelligence, such as a deep neural network (DNN), convoluted neural network (CNN), large language model (LLM), and the like. The AI model 110 may be implemented as a specific processing unit (e.g., a dedicated processing unit) configured to perform one or more specialized operations for the computer system 100 or configured to perform any of the disclosed method acts or other functionalities.

Figure 2:
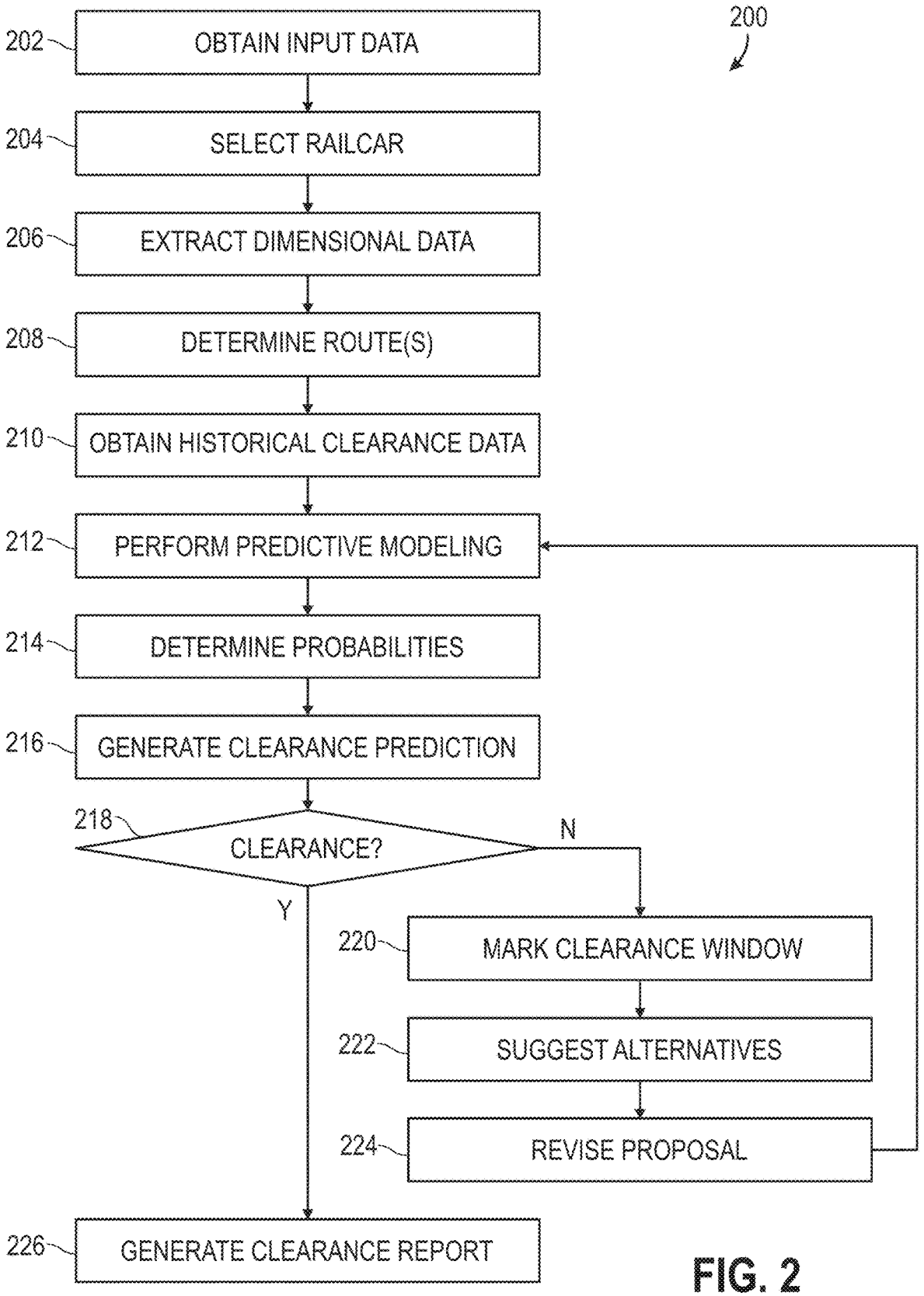
FIG. 2 illustrates a process of determining a transportation route (e.g., railway route) and obtaining a clearance report to transport a load (e.g., transformer, boiler, pressure vessel, power generator, or other large equipment).

Having an overview of the computing environment 50, discussion now turns to FIG. 2, which illustrates a clearance process 200 of determining a transportation route (e.g., railway route) and obtaining a clearance report to transport a load (e.g., transformer, boiler, pressure vessel, power generator, or other large equipment). For better understanding, reference is concurrently made to features of the computer environment 50 in FIG. 1 as well as to features in other figures disclosed herein.

In the clearance process 200, the computer system 100 obtains input data (Block 202). For example, the input data at least includes (i) mapping data for railways, (ii) historical clearance data for the railways, and (iii) schematic data at least associated with a load to be transported. The input data can also include (iv) an origin and a destination for transport of a load carried on a railcar.

To obtain the input data, the processor 106 can access the mapping data 130 and the historical clearance data 140 from storage in the database 102 or from a remote system 118, such as a cloud storage or an enterprise system. As noted previously, the mapping data 130 can include rail network information in one or more geographical locations. As also noted, the historical clearance data 140 can include clearance measurements made along the various rail network routes in one or more geographical locations. For example, various clearance measurements may be periodically made and updated along railroad routes. For instance, laser measuring devices (e.g., LiDAR distance laser) mounted on a vehicle riding along the track can be used to make the measurements. Railways also often make measurements of track centers and curves and maintain that data.

As discussed in more detail below, the input data may already include a railcar to be used to transport the load. For example, this may be contained in schematic data input into the computer system 100. In other instances, schematic data of only the load is input into the computer system. Accordingly, the computer system 100 can provide for the selection of a railcar to be used to transport the subject load (Block 204). The selection can be a user-based selection received by a user in a graphical user interface.

The computer system 100 now extracts dimensional data (Block 206). In particular, the image processing module 112 processes the schematic data of at least the load. Based on the processed data, the processors determine dimensional parameters associated with the load carried on the railcar. In turn, based on the dimensional parameters, the image processing module 112 defines a transport envelope of the load carried on the railcar.

With this set up of processed input data, parameters, and transport envelope, the mapping module 114 operates a machine learning algorithm to determine the railway networks connecting between the origin and the destination (Block 208). The rail system in North America is comprehensive and interconnected, and States have few restrictions for moving large loads by rail. As expected, one or more railroad routes over one or more portions of railway networks may be accessible to transport from the origin (O) to the destination (D). The mapping module 114 identifies any of the one or more relevant railroad routes that are accessible.

For example, the mapping module 114 can determine the railway networks connected between the origin and the destination by: discovering any one or more sections of any one or more of the railway networks being interconnected to one another between the origin and the destination; and outlining any one or more routes along the any one or more sections connecting the origin to the destination.

At this stage of the clearance process 200, the predictive modelling module 108 obtains the historical clearance data 140 for the determined route(s) (Block 210). Some of the relevant historical clearance data 140 may be stored in the database 102, and some may be accessed from a remote system 118.

Using the one or more determined route(s), the dimensional parameters, and the historical clearance data, the AI model 110 of the predictive modelling module 108 performs predictive modeling (Block 212) and determines predictive results (e.g., probabilities, confidence intervals, pass-fail scores, tabulated numbers of critical points, etc.) for clearance of the load carried by the railcar along the determined route(s) (Block 214). The predictive results can in general include one or more metrics characterizing the transport envelope of the load carried on the railcar clearing the historical clearance data on the one or more railway routes. As its goal, predictive modelling module 108 seeks to calculate a probability value, a confidence interval, a pass-fail score, a tabulated number of critical points, or other numerical metric of securing suitable clearance along the one or more identified routes. For example, using the AI model 110, the predictive modelling module 108 determines probabilities or other metrics characterizing the transport envelope of the load carried on the railcar clearing obstacles in the historical clearance data on the determined route(s) of the railway network(s). The calculations can use dynamic adjustment factors, safety margins, and accuracy metrics. The analysis for the clearance may also use calculations for any speed restrictions in passing critical points along the railway route. Because the required processing may be intensive, the computer system 100 can use dedicated and/or remote resources to perform the analysis, such as provided by a remote system 118.

Using the AI model 110, the predictive modelling module 108 generates a clearance prediction (Block 216), which is assessed (Decision 218). If the clearance is appropriate (Yes), the predictive modelling module 108 determines, based on the determined probabilities or other metric(s), at least one route on one or more of the determined routes connecting the origin to the destination and generates a clearance report or recommendation (Block 226). The clearance report can include information indicative of the at least one route to transport the load carried on the railcar. This clearance report can be communicated with one or the input-output interfaces, such as a computer screen, a printer, an electronic communication, or the like.

In some instances, the clearance process 200 may produce clearance probabilities or metrics that are not adequate when the clearance process 200 determines whether clearance has been achieved within an appropriate threshold of probability or the like (Decision 218). In general, the AI model 110 can determine that the one or more metrics for the railway routes fail to meet a criterion for the transport envelope of the load carried on the railcar to clear the historical clearance data on the railway routes. For example, the AI model 110 may instead determine that the probabilities fall below a threshold. Should clearance issues arise, the computer system 100 can mark the schematic data, such as the image file, what the "clearance window" would be (Block 220). In this case, the AI model 110 can define at least a maximum clearance window along at least one of the routes having the one or more metrics closest to meeting the criterion, e.g., having at least a higher level of the probabilities. Then, the AI model 110 can suggest one or more alternatives to at least the railcar to match the maximum clearance window (Block 222) and can revise the proposal (Block 224) so the analysis can be repeated. Other alternatives can also be recommended. For example, an alternative railway route may be determined and suggested to the user.

At Block 222, the computer system 100 can also automatically select a railcar type based on characteristics of the load and the identified routes. For example, given the load's dimensional parameters, the historical clearance data, and the one or more identified routes, the computer system 100 may determine an appropriate type of railcar for the load if a specialized form of transport is necessary. For example, the computer system 100 may determine a specialized type of railcar to achieve the transport. To do this, the computer system can reference a database of specialized railcars, either stored in the database or obtained from an external system (e.g., from Kasgro Rail Corporation).

To obtain the input data in Block 202, the schematic data can be manually input by a user in a user interface by filling out form fields for different dimensions of interest. Although this represents one possibility, allowing schematic image data to be used greatly simplifies and streamlines the clearance process. Accordingly, to obtain the input data in Block 202, the schematic data can be schematic image data obtained using an image capture interface, such as a camera, a scanner, or other imaging devices. Alternatively, the schematic data may be an image file stored in the database 102 of the computer system 100, and the processor 106 can access the image file from storage. The image file can be received from a remote system (118) and can be downloaded to the database 102 for later retrieval. Likewise, the image file can be generated with the computer system 100 using appropriate software and stored in the database 102 for later access.

In fact, AI models at remote systems 118 can be accessed through application program interfaces (API) to generate AutoCAD drawings for the image files, including generating code snippets in various programming languages to automate and enhance AutoCAD design processes. Additionally, open-source applications can generate CAD files from text prompts, allowing models to be created and imported into CAD programs.

Figure 3A:
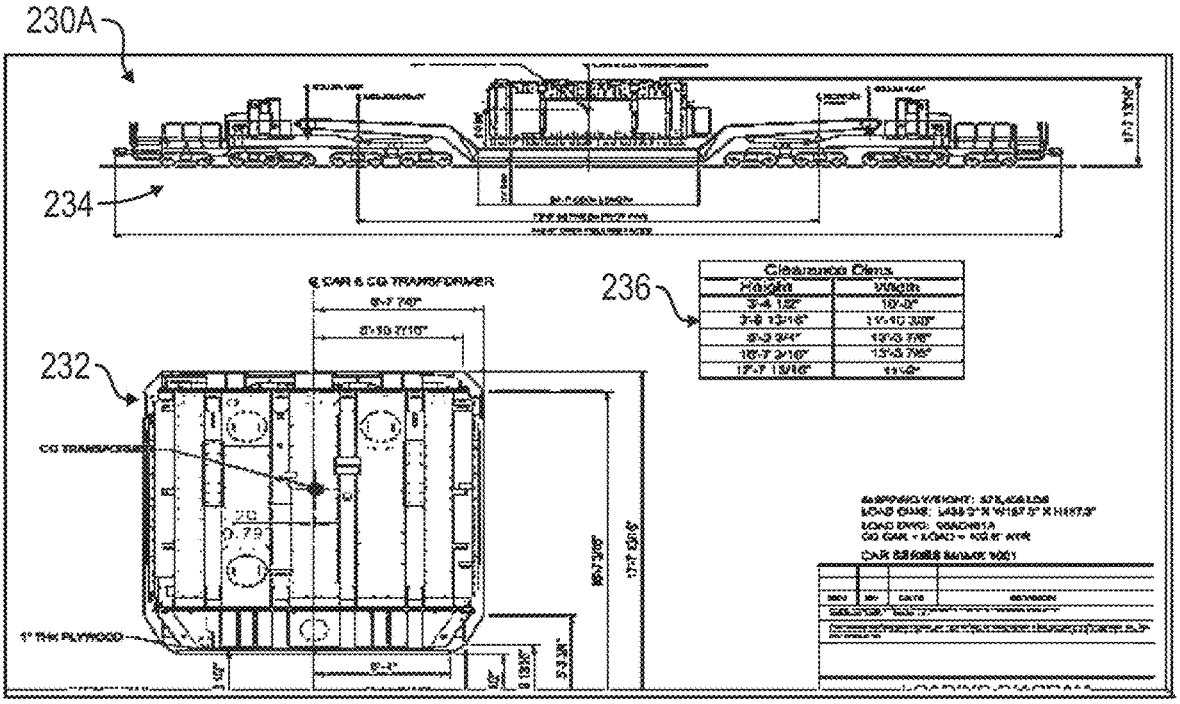
FIGS. 3A and 3B illustrate representations of image files for use by the disclosed computer system.
Figure 3B:
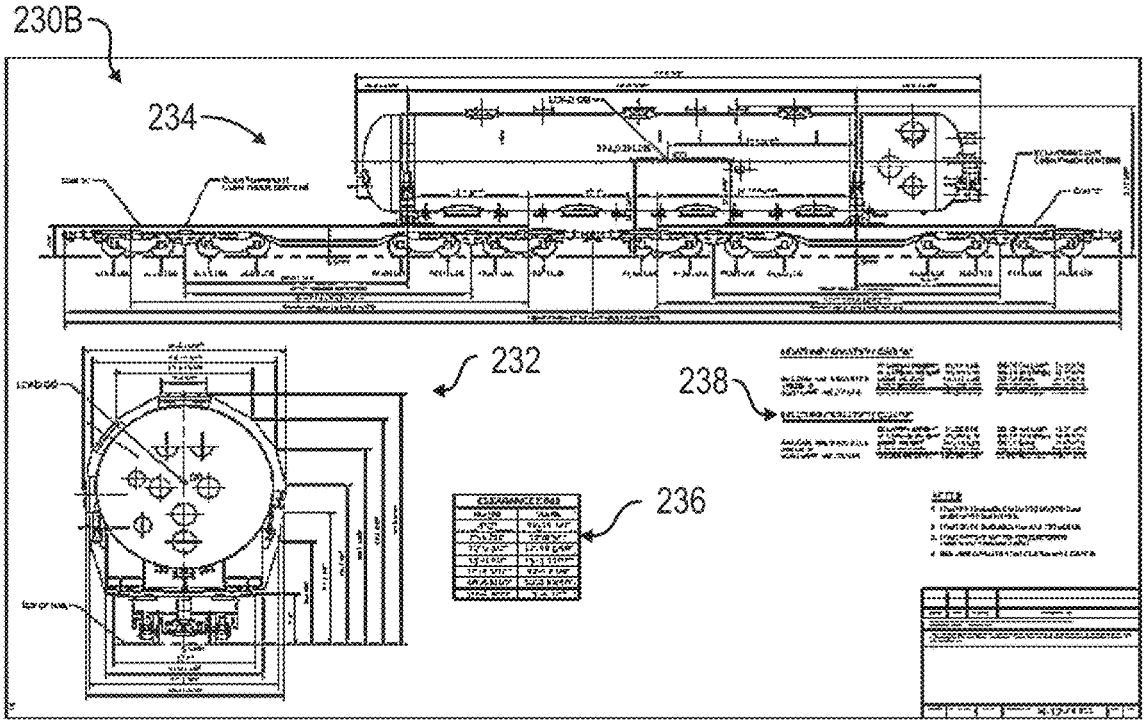

As examples, FIGS. 3A and 3B illustrate representations of image files 230A-B for use by the disclosed computer system 100. These image files 230A-B can include any combination of depictions of the load with dimensional information, depictions of a railroad car with dimensional information, and tables and/or other textual information. For example, the image files 230A-B in FIGS. 3A-3B include an end view 232 of the load (e.g., transformer) with dimensional information when supported on a selected railroad car. The image files 230A-B also include a side elevational view 234 of the load (e.g., transformer) with dimensional information when supported on the selected railroad car. A table 236 is depicted and includes clearance dimensions in the form of widths of the load on the railroad car at different heights from the rail. Additional textual information 238 may also be provided as shown in the image file 230B. The AI model 110 can use transforms 111 and language models to extract text from any tables 236 and textual information 238 in the image files.

In the clearance process 200 of FIG. 2, dimensional parameters for the load and the railcar can be extracted from these types of image files by the image processing module 112. As an example, manufacturer drawings of the load to be transported can be uploaded to the computer system 100. The load can be equipment, such as a transformer, a boiler, a wind turbine component, or any type of heavy-lift and over-dimension cargo, which requires significant coordination and time to transport. The drawings may also include a selected railcar on which the load is to be transported.

The image file for these drawings can be in a suitable format, such as PDF, AutoCAD, or other formats. The computer system 100 processes the image file to determine dimensional parameters related to the load and the railcar (if present in the image file). These dimensional parameters can include one or more values for the load's vertical dimension (e.g., height), lateral dimension (e.g., width, diameter, etc.), and the longitudinal dimension (e.g., length).

Moreover, more than one image file can be uploaded to, retrieved from, or generated by the computer system 100 to be processed and combined, such as one image file for the load and another image file for the railcar. If the image files uploaded to the computer system do not include the railcar, for example, then one or more separate image files for the desired railcar may be uploaded to the computer system. Alternatively, a particular railcar can be separately selected in the computer system 100, and the dimensions for the railcar combined with the dimensional parameters of the load extracted from the image file. For example, user selections can be made in a user interface of the computer system to select a desired railcar. Typical rail cars include a flat car, a bulkhead flat car, a gondola car, a hopper car, and the like.

To determine the dimensional parameters associated with the load carried on the railcar, first dimensional parameters associated with the load can be determined by processing the schematic image data of the load without image data of a railcar to be used. Instead, a user-based selection of the railcar can be obtained using a graphical user interface, and the selection can be obtained from storage in the database. Alternatively, the computer system 100 may make the selection of the railcar automatically based on the first dimensional parameters associated with the load as well as any other details related to the load (e.g., name of the load, type of the load, etc.). Second dimensional parameters associated with the selection of the railcar are then added to the first dimensional parameters associated with the load to complete the combined dimensional parameters.

Selecting the railcar for the given load and route(s) by the computer system 100 may take into account one or more parameters, including weight of the load relative to the railcar's capacity, length of the load relative to the platform size of the railcar, height of the load compared to the platform height, number of axles for calculating and approving weight distribution per axle on the railcar, location of the center of gravity (COG) of the load, and availability and cost of the railcar. Not all railcars may be available for every route and departure location. If a specific car is found to be unavailable, the process can adjust the selection accordingly. Railcar data can be accessed directly from remote systems (118) to obtain technical specifications, technical diagrams, and official data from railcar manufacturers.

As an alternative, the schematic image data being processed may have both the load and the railcar included. In this case, the combined dimensional parameters associated with the load carried on the railcar can be completed based on processing the image data.

Figure 4:
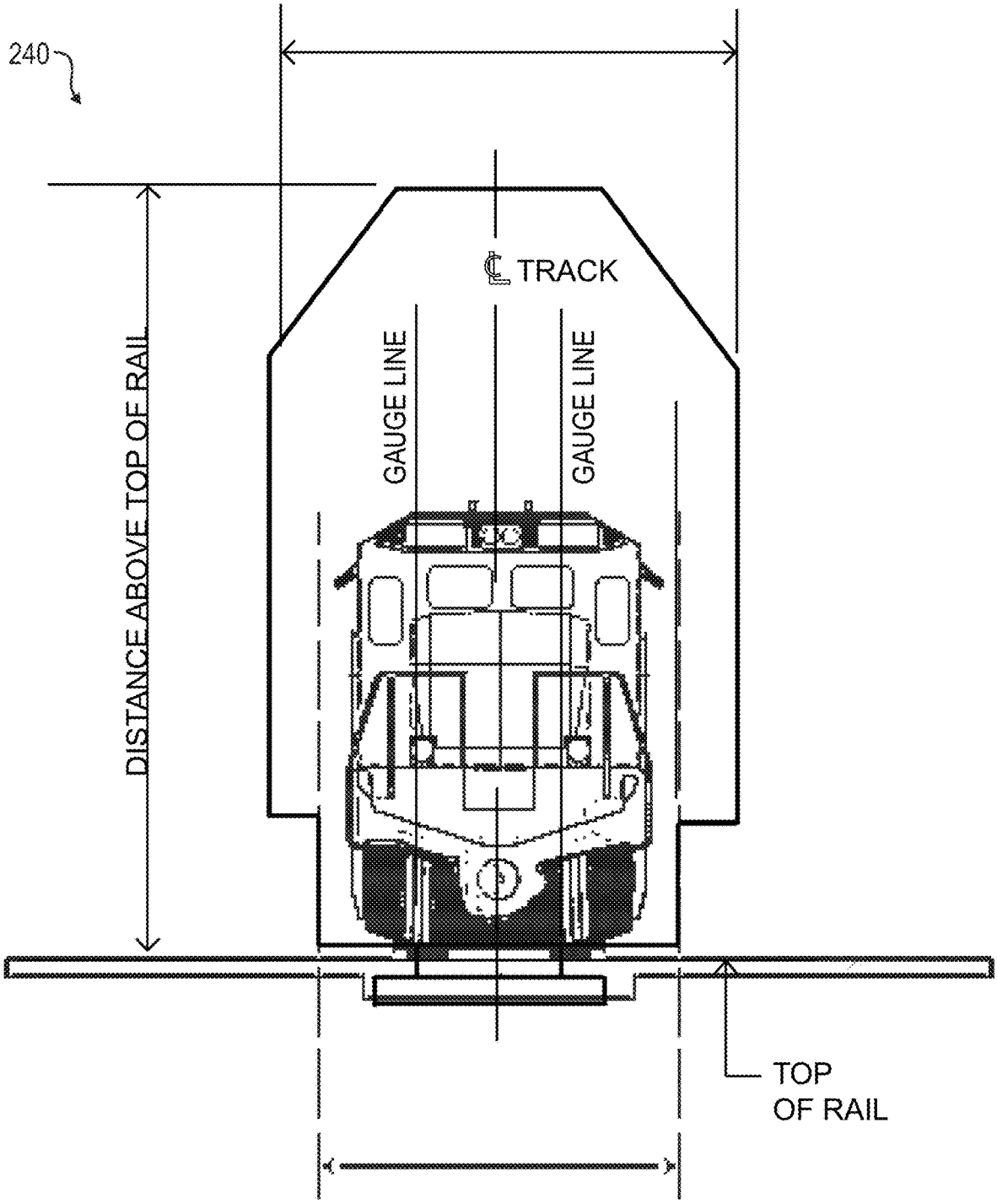
FIG. 4 illustrates an example of a maximum clearance profile for a railcar on a railway.

To define the transport envelope of the load carried on the railcar, the computer system 100 appropriately scales and combines the dimensional parameters. For better understanding of the transport envelope, FIG. 4 illustrates an example of a maximum clearance profile 240 for a train on a railway. As noted above, dimensional parameters can include one or more values for the load's vertical dimension (e.g., height), lateral dimension (e.g., width, diameter, etc.), and the longitudinal dimension (e.g., length). Additionally, the dimensional parameters of the computer system 100 can include one or more values of the railcar's vertical dimension (e.g., height), lateral dimension (e.g., width, diameter, etc.), and longitudinal dimension (e.g., length). Moreover, given that the load is to be carried on the railcar and may be held on various support structures, the dimensional parameters can include one or more values for the combined vertical dimension (e.g., combined height above the rail), lateral dimension (e.g., width, diameter, etc.), and the longitudinal dimension (e.g., length). Additional parameters, such as weight, horizontal center of gravity relative to the geometric center, combined vertical center of gravity above the rail, etc., related to the load and/or transport may be extracted from the image file or received through user inputs.

The clearance in the maximum clearance profile 240 is defined as a distance from an outer edge of the load to structures on the railroad right-of-way. Many railroads have different minimum clearance distances to be met. The clearance required can also be related to the speed of the railcar passing the structure. For example, a smaller clearance distance would relate to a slower speed, whereas a greater clearance distance would relate to a higher speed. Some obstacles may require the train to pass at walking speed to pass the obstacle. A predefined clearance distance may be needed for the railcar to travel at track speed past the structure. Because trains on adjacent rails may pass by the load, clearance requirements also account for the track centers (i.e., the distance from the centerline of one track to the centerline of adjacent track(s)).

In general, a "loading gauge" can refer to a maximum physical size of a railcar and its load. By measuring various dimensions along the length of the railcar and carried load, the processor can determine the loading gauge for the specific configuration. Although the loading gauge describes the outer dimensions of configuration of the railcar and its load, the railcar with the load can occupy a more dynamic envelope representing a larger volume that rolling stock can occupy as it travels along a railway track at speed.

Figure 5A:
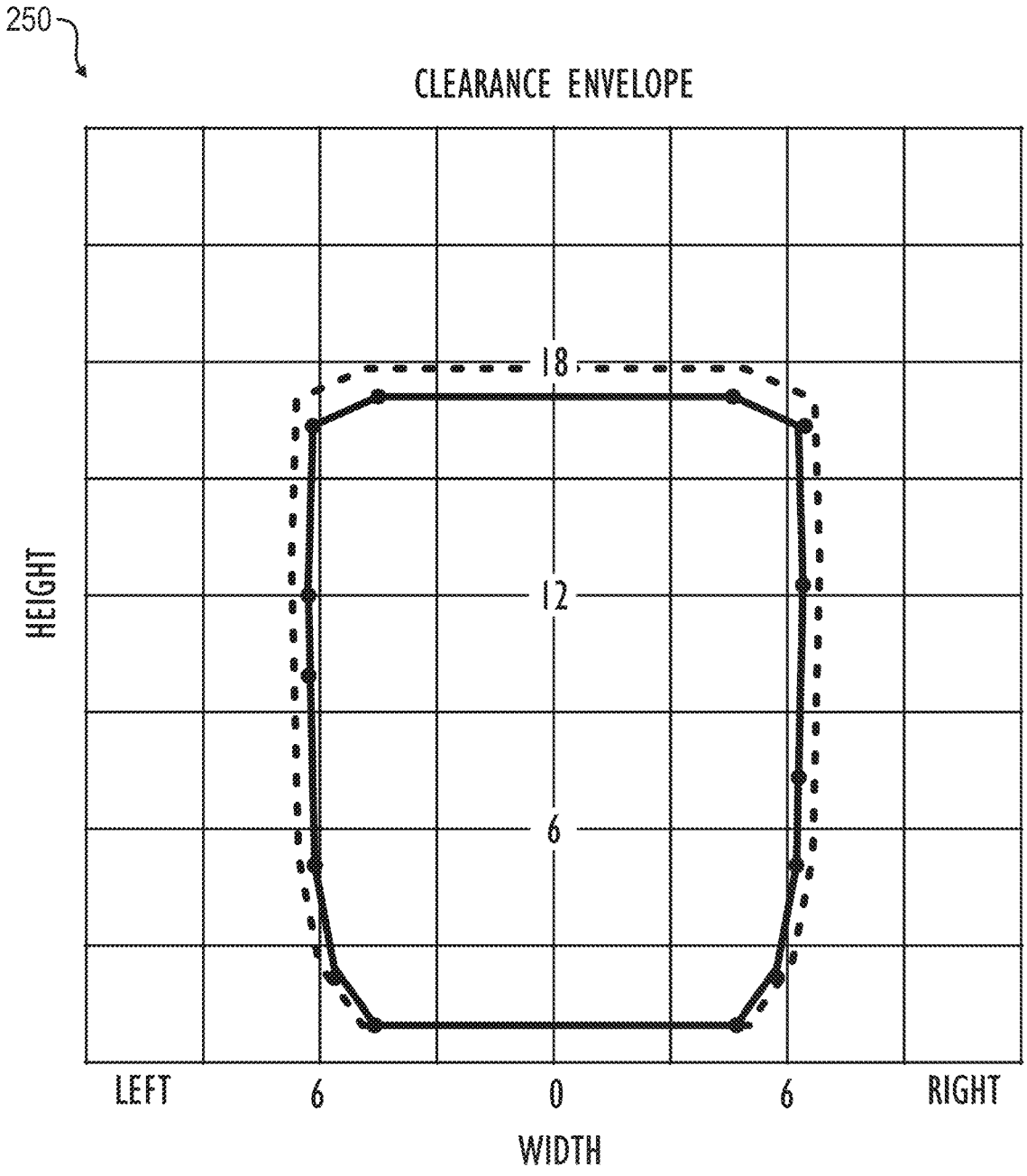
FIG. 5A illustrates an example of a calculated clearance envelope for a railcar and a load.

For example, FIG. 5A illustrates an example of a calculated clearance envelope 250 for a railcar and a load. The envelope is generally defined by the combination of height, width, and the edge chamfers from both the top and bottom corners of the load profile (front view) on the railcar relative to the top of the rail and the centerline. Lateral swaying, vertical bouncing, track canting around corners, and the like can produce the larger dynamic clearance envelope, which is also shown in FIG. 5A.

Figure 5B:
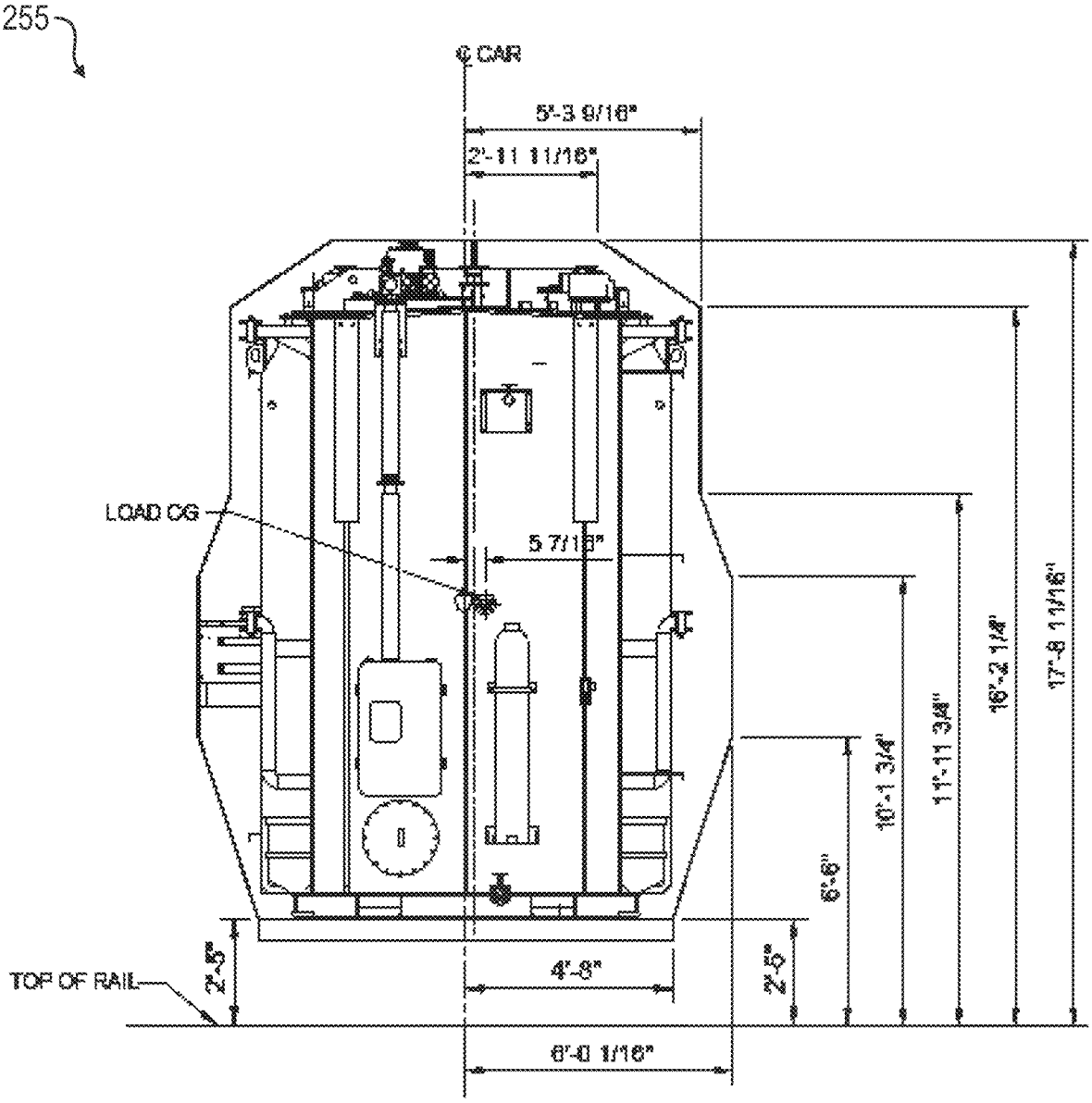
FIG. 5B illustrates a more detailed example of a calculated clearance envelope for a railcar and a load.

For further explanation, FIG. 5B illustrates a more detailed example of a calculated clearance envelope 255 for a railcar and a load. In this example, the load is a transformer. The railcar (not shown) in this example is 9' 4" wide and 2' 5" high. Multiple coordinates (i.e., widths relative to the railcar's centerline at specific heights from the top of rail) for the geometric data are detailed for the load, and the profile for the calculated clearance envelope 255 is defined by these coordinates. The load's center of gravity is also given.

As noted previously, the predictive modelling module 108 in FIG. 2 calculates a distance between obstacles (structures, etc.) and the clearance envelope of the railcar and the load. The calculation may account for the speeds at which the envelope can pass. Additionally, the calculation can account for appropriate track tolerances and the accuracy of measurements. The clearance envelope developed by the computer system 100 may be displayed in a graphical user interface, and the user may be able to make adjustments and refinements in the interface.

In the predictive analysis, the clearance envelope of the load on the railcar is checked for fit and clearance issues along the route(s). Clearance data along the route is accessed from a clearance database to perform the comparative fit. Weight restrictions (e.g., weight restriction data) along the route are also checked in the comparison. Therefore, the criteria for the clearance prediction may account for the overall size and gross weight of the load, the maximum allowable dimensions ("envelope"), and the combined weight and size of load and railcar for the route.

For height and width of the load on the railcar, the calculations add together the load's and railcar's height and width, and the calculations check that the combined heights and widths constructing the transport envelope do not exceed the clearance limitations defined in the maximum allowable dimensions ("envelope") for a given route. To calculate the weight per axle, the weight of the load is combined with the weight of the empty car, and the total weight is divided by the number of axles on the car. The aim is to keep the center of gravity (COG) of the load as close as possible to the center of the railcar, using counterweights if necessary. Additionally, the COG of the load is preferably as close as possible to the longitudinal center of the railcar to avoid creating an imbalance in the weight distribution that exceeds certain thresholds, such as 10% on either axle group (front or rear).

Figure 6:
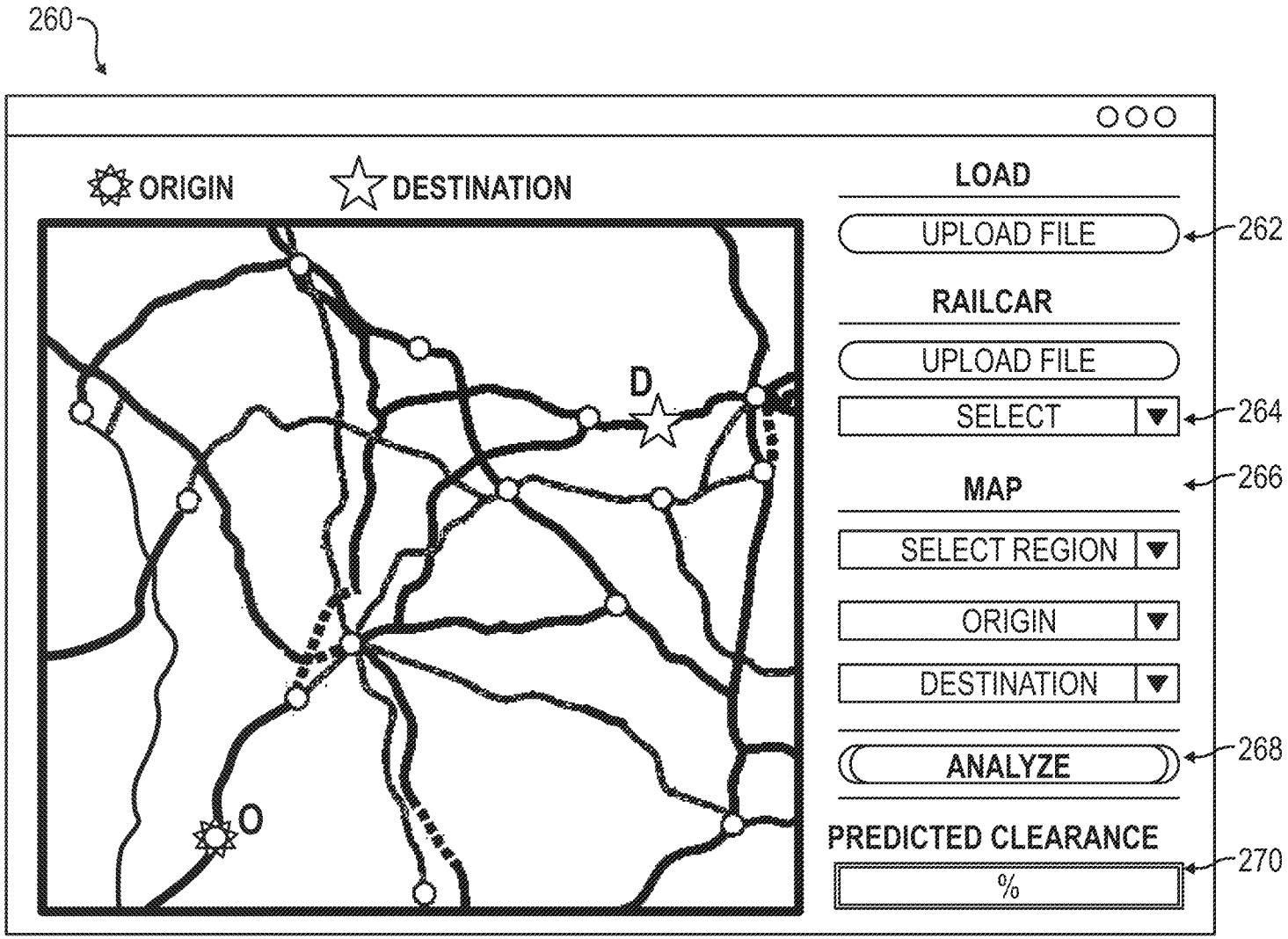
FIG. 6 illustrates a graphical user interface for information for the transportation of a load.

As noted above, the computer system 100 can receive user inputs for the transportation of the load. To obtain the input data, for example, the computer system 100 can obtain the origin and the destination using a graphical user interface. For example, FIG. 6 illustrates an example graphical user interface 260 for configuring, selecting, and entering information. As will be appreciated, any number of formats can be used for the graphical user interface 260 of the computer system (100).

In this example, upload of a schematic image file can be selected for the load and railcar (262). A drop-down selection (264) of available railcars can be used. Geographical regions (266) for mapping can be selected, and an origin and a destination for the transportation of a load can be selected or entered. Within the graphical user interface 260, the mapping information may be selectable as stored locations in the computer system, may be selectable locations on a visual map, or may be form fields for entering physical addresses, locations, or other geographical information.

Once schematic image file(s) and other inputs are entered, analysis (268) can be initiated in the graphical user interface 260 to determine the clearance envelope and provide a result (270) for the given inputs. As disclosed herein, the result (270) can take the form of a predictive clearance value, e.g., an estimate of how the given load on the selected railcar can clear the various clearance limits that are known on the one or more selected routes. The results (270) can be calculated as a percentage, a confidence level, or another numerical value. The results (270) can be arranged in a hierarchy or other type of comparison. The results (270) can be output in another graphical user interface, in tables, and in any other suitable format.

Should the predicted clearance fall below a predefined threshold or other metric, the computer system (100) can highlight any issues in the results (270), such as pinpointing any critical points where clearance is restricted or obstructed. The computer system (100) can also determine and provide a suggested alteration within the results (270). For example, the computer system (100) can provide one or more alternative railroad cars for transporting the load. Also, the computer system (100) can provide one or more alternative routes for transporting the load.

As noted above, the disclosed systems and methods use AI techniques, such as a convolutional neural network (CNN) for image-based evaluations. The CNN is trained directly with graphical representations to evaluate and classify the quality of the threaded tubular connections.

Figure 7:
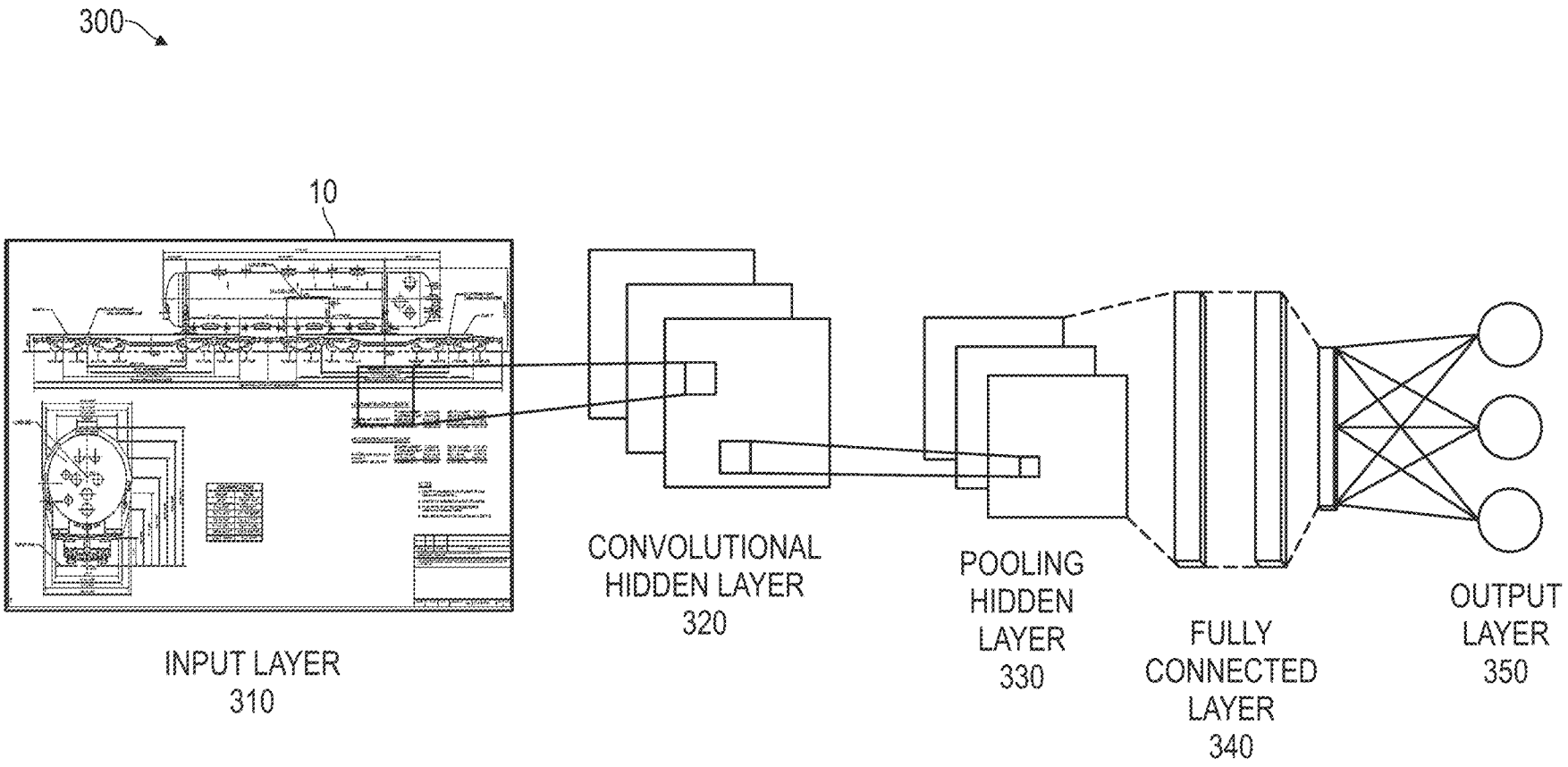
FIG. 7 schematically illustrates a convolutional neural network used for analysis by the disclosed system.

FIG. 7 schematically illustrates a convolutional neural network (CNN) 300 used for automated evaluation and analysis of graphical representations in a computing environment. (Reference numerals to elements in other figures are provided in the discussion below.)

Again, the computing environment (50) can include the computer system (100), remote system (118), and processes (200) discussed above. The CNN 300 is a type of deep neural network (DNN) having three additional features: local receptive fields, shared weights, and pooling. An input layer 310 and an output layer 350 of the CNN 300 function similar to the input and output layers of a DNN. However, the CNN 300 is distinguished from a DNN in that hidden layers of the DNN are replaced with one or more convolutional hidden layers 320, pooling hidden layers 330, and fully connected hidden layers 340.

Using localized receptive fields, nodes in the convolutional hidden layers 320 receive inputs from localized regions in the previous layer. Meanwhile, using shared weights, each node in a convolutional hidden layer 320 assigns the same set of weights to the relative positions of a localized region.

The input layer 310 of the CNN 300 includes data representing an image (e.g., a graphical representation, graphical user interface, graphs, curves, tables, etc. uploaded to the image processing module 112). For example, the data can include an array of numbers representing the pixels of the image, with each number in the array including a value from 0 to 255 describing the pixel intensity at that position in the array. The image can be passed through a convolutional hidden layer 320, an optional non-linear activation layer (not shown), a pooling hidden layer 330, and fully connected hidden layers 340 to get an output at the output layer 350. While only one of each hidden layer is shown in the present example, it is appreciated that multiple convolutional hidden layers 320, non-linear layers, pooling hidden layers 330, and/or fully connected hidden layers 340 can be included in the CNN 300.

The first layer of the CNN 300 is the convolutional hidden layer 320, which analyzes the image data of the input layer 310. Each node of the convolutional hidden layer 320 is connected to a region of nodes (pixels) of the input image called a receptive field. The convolutional hidden layer 320 can be considered as one or more filters (each filter corresponding to a different activation or feature map), and each convolutional iteration of a filter can be considered a node or neuron of the convolutional hidden layer 320. For example, the region of the input image that a filter covers at each convolutional iteration would be the receptive field for the filter. Each connection between a node and a receptive field for that node learns a weight and, in some cases, an overall bias such that each node learns to analyze its particular local receptive field in the input image. Each node of the convolutional hidden layer 320 will have the same weights and bias (called a shared weight and a shared bias). For example, the filter has an array of weights (numbers) and the same depth as the input.

The convolutional nature of the convolutional hidden layer 320 is due to each node of the convolutional layer being applied to its corresponding receptive field. At each convolutional iteration, the filter's values are multiplied by a corresponding number of the original pixel values of the image data. The multiplications from each convolutional iteration can be summed together to obtain a total sum for that iteration or node. The process is continued at a next location in the input image according to the receptive field of the next node in the convolutional hidden layer 320. For example, a filter can be moved by a step amount to the next receptive field. Processing the filter at each unique location of the input volume produces a number representing the filter results for that location, resulting in a total sum value being determined for each node of the convolutional hidden layer 320.

The mapping from the input layer 310 to the convolutional hidden layer 320 is referred to as an activation map (or feature map). The activation map includes a value for each node representing the filter results at each location of the input volume. The activation map can include an array containing the various total sum values resulting from each iteration of the filter on the input volume. The convolutional hidden layer 320 can include several activation maps to identify multiple features in an image.

Applied after the convolutional hidden layer 320, the pooling hidden layer 330 simplifies the information in the output from the convolutional hidden layer 320. The pooling hidden layer 330 takes each activation map output from the convolutional hidden layer 320 and generates a condensed activation map using a pooling function. Max-pooling is one example of a pooling function that can be performed by the pooling hidden layer 330. The pooling hidden layer 330 may also use other known forms of pooling functions. The pooling function is applied to each activation map in the convolutional hidden layer 320.

In the final layer of connections in the CNN 300, the fully connected hidden layer 340 connects every node from the pooling hidden layer 330 to every one of the output nodes in the output layer 350. The fully connected hidden layer 340 obtains the output of the previous pooling hidden layer 330 (which represents the activation maps of high-level features) and determines the features that best correlate to a particular class. For example, the fully connected hidden layer 340 can determine the high-level features that strongly correlate to a particular class and can include weights (nodes) for the high-level features. A product can be computed between the weights of the fully connected hidden layer 340 and the pooling hidden layer 330 to obtain probabilities for the different classes. For example, if the CNN 300 is being used to predict that an object is a torque-turns curve, high values will be present in the activation maps that represent high-level features of a torque-turns curve.

As noted previously, the modules (e.g., the predictive machine learning module 108, the image processing module 112, and the mapping module 114) can be implemented using appropriate forms of artificial intelligence, such as a deep neural network or other AI models. In the ML pipeline, the AI models of the present disclosure can be trained by a software framework of a machine learning engine that manages, trains, deploys, and serves the AI model 110 according to the present disclosure. Existing engines, such as TensorFlow Serving or AWS SageMaker, can provide the infrastructure to deploy the AI model 110 of the present disclosure.

As an example, FIG. 7 illustrates a training process 400 for a training framework to train and deploy a neural network 418 in which configurations of the present technology may be implemented. The neural network 418 includes an input layer, a plurality of hidden layers, and an output layer. The neural network 418 can be a deep neural network (DNN), a deep auto-encoder neural network (deep ANN), a convolutional neural network (CNN), a recurrent neural network (RNN), or any other suitable neural network.

For the purposes of the present disclosure, the neural network 418 for the image processing module (112) can use a CNN as discussed herein to process schematic data for image file(s). The CNN is specifically designed for working with grid-like data, such as images, and can effectively perform tasks, such as image classification, object detection, image segmentation, and the like. The CNN uses convolutional layers to automatically detect patterns, such as edges, textures, and shapes, within the schematic image data to capture spatial hierarchies. Pooling layers within CNN reduce the spatial size of the representation, making the model less sensitive to small shifts or distortions in the image.

For the purposes of the present disclosure, the predictive modeling module (108) can use a DNN because the input data may be complex and unstructured. The DNN can handle the complex data structures to learn intricate patterns. The deep learning models, including CNNs, RNNs, and transformers, can be employed. For example, two or three-dimensional models of the railcar/load and obstacle clearances can train CNNs to predict whether the railcar can pass through specific obstacles on the railways. The model can analyze the shape and clearance of obstacles and compares them with the load/railcar's dimensions.

For the purposes of the present disclosure, the mapping module (114) can use any number of algorithms to determine routes, pathways, and logistics between the original and destination along the railways. For example, the mapping module (114) can use a Graph Neural Network (GNN) for graph-based route planning. Other algorithms include Genetic Algorithm (GA), Ant Colony Optimization (ACO), Mixed Integer Linear Programming (MILP), and Heuristic Search Algorithm.

In the end, each function of the AI models (110, 113, 115) in the various modules (108, 112, 114) could be combined together in a neural network.

As illustrated, the neural network 418 may have any number of two or more hidden layers. Each layer may have one or more nodes (represented by circles in the diagrammatic network). As depicted by the connecting lines, each node in a current layer is connected to every other node in a previous layer and a next layer. This is referred to as a fully connected neural network. Other neural network structures are also possible in alternative arrangements of the neural network 418, in which not every node in each layer is connected to every node in the previous and next layers.

Each node in the input layer can be assigned a value and output that value to every node in the next layer (e.g., hidden layer). The nodes in the input layer can represent features about a particular image. For example, a DNN used for classifying whether an object is a rectangle may have an input node representing whether the object has flat edges. In this example, assigning a value of 1 to the node may represent that the object does have flat edges and assigning a value of 0 to the node may represent that the object does not have flat edges. In another example, for the DNN taking an image as input, the input nodes may each represent a pixel of the image, such as a pixel of a training image, where the assigned value may represent the intensity of the pixel. Following this example, an assigned value of 1 may indicate that the pixel is completely black and an assigned value of 0 may indicate that the pixel is completely white.

Each node in the hidden layers can receive an output value from nodes in a previous layer (e.g., input layer) and associate each of the nodes in the previous layer with a weight. Each hidden node can then multiply each of the received values from the nodes in the previous layer with the weight associated with the nodes in the previous layer and output the sum of the products to each node in the next layer.

Nodes in the output layer handle input values received from the nodes in the hidden layer in a similar fashion. In one example, each output node in the output layer may multiply each input value received from each node in the previous layer (e.g., hidden layer) with a weight and sum the products to generate an output value. The output value of each output node can output information in a predefined format, where the information has some relationship to the corresponding information from the previous layer. Example outputs may include, but are not limited to, classifications, relationships, measurements, instructions, and recommendations. For example, a DNN that classifies whether the object is an ellipse, where an output value of 1 from the output node represents that the object is an ellipse and an output value of 0 represents that the object is not an ellipse. While the examples provided relate to classifying geometric shapes, this is only for illustrative purposes. The output nodes can also be used to classify any of a wide variety of objects and other features and otherwise output any of a wide variety of desired information in desired formats.

Figure 8:
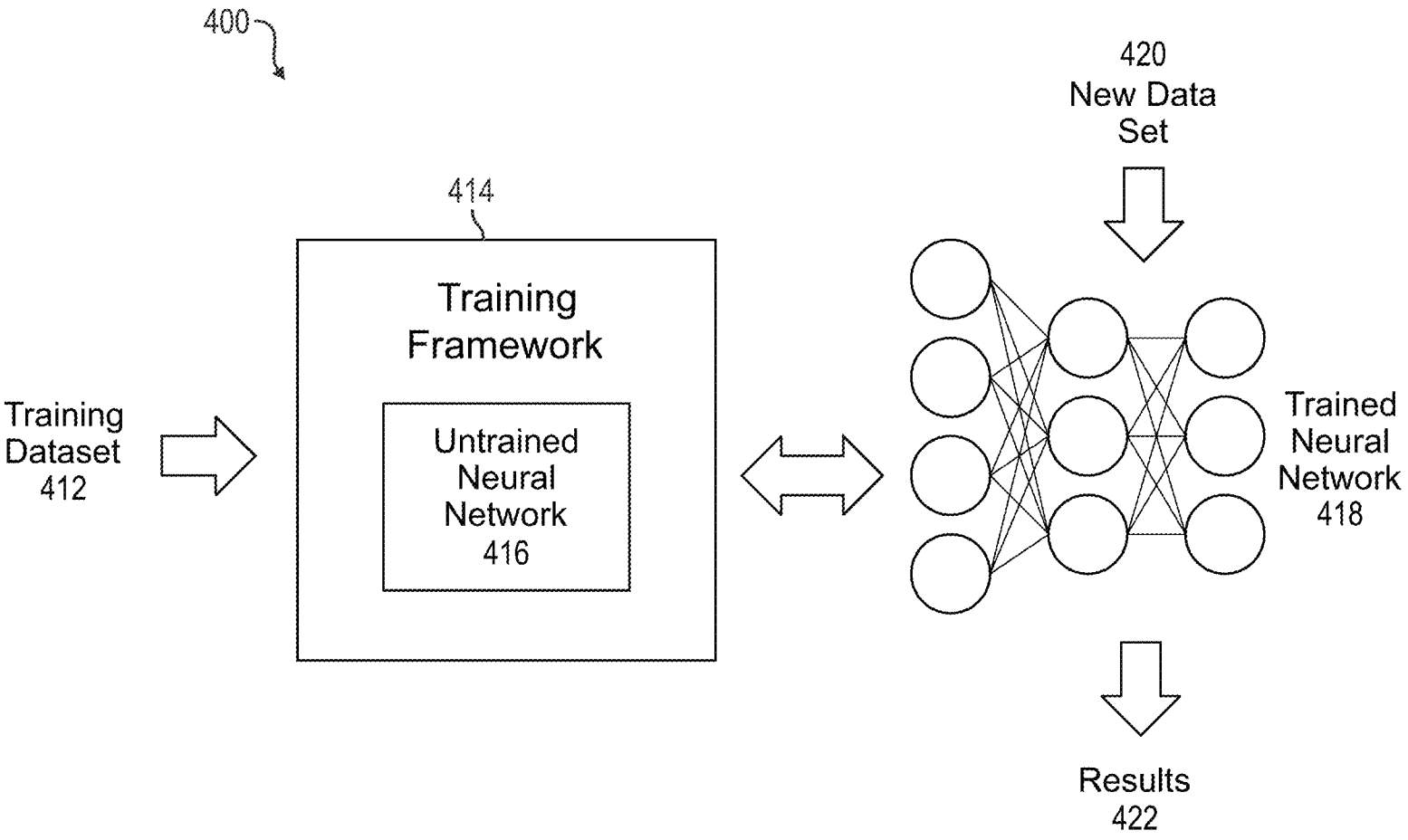
FIG. 8 illustrates a process for training and deploying a deep neural network for the disclosed computer system.

As further shown, FIG. 8 also illustrates the training process 400 for a training framework 414 to train and deploy a neural network 418 according to the present disclosure. Again, in the ML pipeline, the AI models of the present disclosure can be trained by a software framework of a machine learning engine that manages, trains, deploys, and serves the AI model according to the present disclosure. Once a given untrained neural network 416 has been structured for a task, the untrained neural network 416 is trained using a training dataset 412 in the training framework 414.

To begin training, initial weights may be chosen randomly, by pre-training using a deep belief network, or by using pre-trained models. The training cycle can then be performed in either a supervised or unsupervised manner.

Supervised learning uses the training dataset 412 to teach the neural network 418 to yield the desired output. The training dataset 412 includes inputs and desired outputs, which allow the neural network 418 to learn over time, or when the training dataset 412 includes input having known output and the output of the neural network 418 is manually graded. The neural network 418 processes the inputs and compares the resulting outputs against a set of expected or desired outputs. Errors are then propagated back through the training framework 414.

As training proceeds, the training framework 414 can adjust and change the weights that control the untrained neural network 416. The training framework 414 can provide tools to monitor how well the untrained neural network 416 is converging towards a model suitable for generating correct answers based on known input data. The training process repeatedly occurs as the network weights are adjusted to refine the output generated by the neural network 418. The training process 400 can continue until the untrained neural network 416 reaches a statistical accuracy associated with a trained neural network 418. Given a new data set 420, the trained neural network 418 can then be deployed in the disclosed computer system (100) to implement any number of machine learning operations to output a result 422.

Supervised learning is typically separated into two types of problems-classification and regression. Classification uses an algorithm to assign test data accurately into specific categories. Regression is used to understand the relationship between dependent and independent variables. Numerous different algorithms and computation techniques can be used in supervised machine learning, including but not limited to, neural networks, naïve bayes, linear regression, logistic regression, support vector machines (SVM), k-nearest neighbor, and random forest.

As previously noted, unsupervised learning is a learning method in which the network uses algorithms to analyze and cluster unlabeled data. These algorithms discover hidden patterns or data groupings. Therefore, the training dataset 412 includes input data without any associated output data. The untrained neural network 416 can learn groupings within the unlabeled input and can determine how individual inputs relate to the overall dataset.

Unsupervised training can be used for three main tasks-clustering, association, and dimensionality. Clustering is a data mining technique that groups unlabeled data based on similarities and differences. This technique is often used to process raw, unclassified data objects into groups represented by structures or patterns in the information. Association is a rule-based method for finding relationships between variables in a given dataset. Dimensionality reduction is used when a given dataset's number of features (dimensions) is too high. This technique is commonly used in the preprocessing of data.

Variations of supervised and unsupervised training may also be employed. Semi-supervised learning is a technique in which the training dataset 412 includes a mix of labeled and unlabeled data of the same distribution. Incremental learning is a variant of supervised learning in which input data is continuously used to train the model further. Incremental learning enables the trained neural network 418 to adapt to the new data set 420 without forgetting the knowledge instilled within the network during initial training.

The techniques of the present disclosure can be implemented in digital electronic circuitry, or in computer hardware, firmware, software, or in combinations of these. Apparatus for practicing the disclosed techniques can be implemented in a computer program product tangibly embodied in a machine-readable storage device for execution by a programmable processor; and method steps of the disclosed techniques can be performed by a programmable processor executing a program of instructions to perform functions of the disclosed techniques by operating on input data and generating output. The disclosed techniques can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object-oriented programming language, or in assembly or machine language if desired; and in any case, the language can be a compiled or interpreted language. Suitable processors include, by way of example, both general and special purpose microprocessors. Generally, a processor will receive instructions and data from a read-only memory and/or a random-access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM disks. Any of the foregoing can be supplemented by, or incorporated in, ASICs (application-specific integrated circuits).

The foregoing description of preferred and other embodiments is not intended to limit or restrict the scope or applicability of the inventive concepts conceived of by the Applicants. It will be appreciated with the benefit of the present disclosure that features described above in accordance with any configuration or aspect of the disclosed subject matter can be utilized, either alone or in combination, with any other described feature, in any other configuration or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

The invention claimed is:

1. A computer-implemented method, comprising:

obtaining input data with one or more interfaces in a computing environment, the input data at least including (i) clearance data associated with one or more railway routes, and (ii) one or more schematic drawings at least associated with a load to be transported; and operating one or more artificial intelligence models on one or more processors in the computing environment to:

process the one or more schematic drawings at least associated with the load;

determine dimensional parameters at least associated with the load based on the processing of the one or more schematic drawings;

define a transport envelope of the load carried on a railcar based on the dimensional parameters;

determine that one or more metrics characterizing the transport envelope of the load carried on the railcar fail to meet a criterion to clear the clearance data on each of the one or more railway routes;

determine, based on the one or more metrics, at least one recommendation for the transport envelope of the load carried on the railcar to clear the clearance data on the one or more railway routes by operating the one or more artificial intelligence models to:

define at least a maximum clearance window along at least one of the one or more railway routes having the one or more metrics closest to meeting the criterion; and determine at least one alternative railcar to replace at least the railcar to transport the load to match the maximum clearance window; and generate output information, based on the at least one recommendation, indicative of the at least one of the one or more railway routes to transport the load carried on the at least one alternative railcar.

2. The computer-implemented method of claim 1, wherein obtaining the one or more schematic drawings comprises at least one of:

accessing the one or more schematic drawings from an interface with storage in the computing environment;

obtaining the one or more schematic drawings with an image capture interface; and obtaining the one or more schematic drawings with a network interface.

3. The computer-implemented method of claim 1, wherein operating the one or more artificial intelligence models to determine the dimensional parameters comprises:

determining first of the dimensional parameters associated with the load by processing the one or more schematic drawings at least associated with the load; and adding second of the dimensional parameters associated with the railcar to the first dimensional parameters associated with the load.

4. The computer-implemented method of claim 1, wherein operating the one or more artificial intelligence models to determine the dimensional parameters comprises at least one of:

receiving a user-based selection of the railcar from one or more railcars in railcar data in the computing environment, and adding second of the dimensional parameters associated with the railcar in the user-based selection to first of the dimensional parameters associated with the load;

processing the one or more schematic drawings depicting the load carried on the railcar, and determining the dimensional parameters for the load and the railcar from the processing; and processing one or more separate schematic drawings of the railcar in the railcar data, and adding second of the dimensional parameters associated with the railcar to first of the dimensional parameters associated with the load.

5. The computer-implemented method of claim 1, wherein to determine the dimensional parameters, define the transport envelope, determine the one or more metrics, and determine the at least one recommendation, the method comprises operating the one or more artificial intelligence models to automatically select the railcar to transport the load based on characteristics of the load, the railcar, and the one or more railway routes.

6. The computer-implemented method of claim 5, wherein to automatically select the railcar comprises accounting for one or more of: a weight of the load relative to a capacity of the railcar selected, a length of the load relative to a platform size of the at railcar selected, a height of the load compared to a platform height of the railcar selected, a weight distribution per axle of the railcar selected, a location of a center of gravity (COG) of the load, availability of the railcar selected, and a cost of the railcar selected.

7. The computer-implemented method of claim 1, wherein obtaining the input data comprises obtaining (iii) mapping data associated with the one or more railway routes, the mapping data including an origin and a destination for transport of the load; and wherein operating the one or more artificial intelligence models comprises operating the one or more artificial intelligence models to determine, based on the mapping data, the one or more railway routes connecting between the origin and the destination.

8. The computer-implemented method of claim 7, wherein operating the one or more artificial intelligence models to determine the one or more railway routes connecting between the origin and the destination comprises:

discovering any one or more sections of any of the one or more railway routes being interconnected to one another between the origin and the destination; and outlining the any one or more sections of the any of the one or more railway routes connecting the origin to the destination.

9. The computer-implemented method of claim 1, wherein operating the one or more artificial intelligence models to determine the one or more metrics comprises fitting the transport envelope of the load carried on the railcar in a comparative fit to the clearance data on the one or more railway routes; and characterizing, based on the comparative fit, the one or more metrics for each of the one or more railway routes.

10. The computer-implemented method of claim 1, wherein, in response to the one or more metrics failing to meet the criterion, operating the one or more artificial intelligence models to determine the at least one recommendation comprises discovering at least one alternate railway route to replace at least the one or more railway routes; and wherein generating the output information based on the at least one recommendation comprises generating the output information indicative of the at least one alternate railway route to transport the load carried on the railcar.

11. The computer-implemented method of claim 1, wherein operating the one or more artificial intelligence models to determine the one or more metrics comprises determining that the one or more metrics of at least one of the one or more railway routes meet a criterion; and wherein generating the output information based on the at least one recommendation comprises generating the output information indicative of the at least one of the one or more railway routes to transport the load carried on the railcar.

12. The computer-implemented method of claim 1, wherein operating the one or more artificial intelligence models comprises at least utilizing one or more of:

a first model trained to determine dimensions from image data and to calculate envelopes from the dimensions;

a second model trained to find optimal paths along the one or more railway routes; and a third model trained to predict clearance based on an analysis of the clearance data, the envelopes, and the optimal paths.

13. The computer-implemented method of claim 1, wherein to determine the dimensional parameters based on the processing, the method comprises operating the one or more artificial intelligence models to extract, using at least one of a transform and a language model, one or more dimension values of at least the load from one or more of tabular information, textual information, and visual depictions in the one or more schematic drawings.

14. The computer-implemented method of claim 13, wherein the one or more dimension values comprise a height of the load, a height of the railcar, a width of the load, a width of the railcar, a length of the load, a combined height of the load and railcar above rail, a horizontal center of gravity relative to a geometric center, and a combined vertical center of gravity of the load and railcar above rail.

15. The computer-implemented method of claim 13, wherein to determine the dimensional parameters based on the processing, the method comprises operating the one or more artificial intelligence models to extract, using the at least one of the transform and the language model, one or more weight values of at least the load in the one or more schematic drawings.

16. The computer-implemented method of claim 1, wherein obtaining the input data comprises obtaining (iv) railcar data from technical information accessed directly from a railcar manufacturer; and wherein operating the one or more artificial intelligence models comprises using the railcar data to determine the one or more metrics.

17. The computer-implemented method of claim 1, wherein obtaining the input data comprises obtaining (iv) one or more guidelines at least associated with one or more railways for the one or more railway routes; and wherein operating the one or more artificial intelligence models comprises using the one or more guidelines to determine the one or more metrics.

18. A non-transitory machine-readable medium, on which are stored instructions for a machine, comprising instructions that when executed cause the machine to:

obtain input data, the input data at least including (i) clearance data associated with one or more railway routes, and (ii) one or more schematic drawings at least associated with a load to be transported on a railcar; and operate one or more artificial intelligence models to:

process the one or more schematic drawings of at least the load;

determine dimensional parameters associated with the load carried on the railcar based on the processing of the one or more schematic drawings;

define a transport envelope of the load carried on the railcar based on the dimensional parameters;

determine that one or more metrics characterizing the transport envelope of the load carried on the railcar fail to meet a criterion to clear the clearance data on each of the one or more railway routes;

determine, based on the one or more metrics, at least one recommendation for the transport envelope of the load carried on the railcar to clear the clearance data on the one or more railway routes by operating the one or more artificial intelligence models to:

define at least a maximum clearance window along at least one of the one or more railway routes having the one or more metrics closest to meeting the criterion; and determine at least one alternative railcar to replace at least the railcar to transport the load to match the maximum clearance window; and generate output information, based on the at least one recommendation, indicative of the at least one of the one or more railway routes to transport the load carried on the at least one alternative railcar.

19. A system comprising:

one or more databases storing clearance data for one or more railway routes;

one or more interfaces being configured to obtain input data, the input data at least including one or more schematic drawings at least associated with a load to be transported on a railcar; and one or more processors operatively couped to the one or more databases and the one or more interfaces, the one or more processors being configured to operate one or more artificial intelligence models to:

process the one or more schematic drawings of at least the load;

determine dimensional parameters associated with the load carried on the railcar based on the processing of the one or more schematic drawings;

define a transport envelope of the load carried on the railcar based on the dimensional parameters;

determine that one or more metrics characterizing the transport envelope of the load carried on the railcar fail to meet a criterion to clear the clearance data on each of the one or more railway routes; and determine, based on the one or more metrics, at least one recommendation for the transport envelope of the load carried on the railcar to clear the clearance data on the one or more railway routes by operating the one or more artificial intelligence models to:

define at least a maximum clearance window along at least one of the one or more railway routes having the one or more metrics closest to meeting the criterion; and determine at least one alternative railcar to replace at least the railcar to transport the load to match the maximum clearance window; and generate output information, based on the at least one recommendation, indicative of the at least one of the one or more railway routes to transport the load carried on the at least one alternative railcar.

20. A computer-implemented method, comprising:

obtaining input data with one or more interfaces in a computing environment, the input data at least including (i) clearance data associated with one or more railway routes, (ii) one or more schematic drawings at least associated with a load to be transported, and (iii) railcar data associated with one or more railcars; and operating one or more artificial intelligence models on one or more processors in the computing environment to:

process the one or more schematic drawings at least associated with the load;

determine first dimensional parameters at least associated with the load based on the processing of the one or more schematic drawings;

obtain second dimensional parameters associated with at least one of the one or more railcars in the railcar data;

define a transport envelope of the load carried on the at least one railcar based on the first dimensional parameters associated with the load combined with the second dimensional parameters associated with the at least one railcar;

compare the transport envelope to the clearance data for the one or more railway routes to determine one or more metrics characterizing the transport envelope clearing the clearance data on the one or more railway routes;

determine at least one first prediction that the one or more metrics characterizing the transport envelope of the load carried on the at least one railcar fails to meet a first criterion to clear the clearance data on each of the one or more railway routes;

in response to the at least one first prediction, define at least a maximum clearance window along at least one of the one or more railway routes having the one or more metrics closest to meeting the first criterion, and determine at least one alternative railcar to replace at least the at least one railcar to transport the load to match the maximum clearance window; and generate output information based on the at least one first prediction, the output information being indicative of the at least one of the one or more railway routes to transport the load carried on the at least one alternative railcar.

21. The computer-implemented method of claim 20, wherein operating the one or more artificial intelligence models to obtain the second dimensional parameters associated with the at least one railcar in the railcar data comprises at least one of:

receiving a user-based selection of the at least one railcar in the railcar data in the computing environment;

processing the one or more schematic drawings depicting the load carried on the at least one railcar; and processing one or more separate schematic drawings of the at least one railcar; and automatically selecting the at least one railcar to transport the load based on characteristics of the load, the at least one railcar, and the one or more railway routes.

22. The computer-implemented method of claim 20, wherein obtaining the input data comprises obtaining (iv) mapping data associated with the one or more railway routes, the mapping data including an origin and a destination for transport of the load; and wherein operating the one or more artificial intelligence models comprises operating the one or more artificial intelligence models to determine, based on the mapping data, the one or more railway routes connecting between the origin and the destination.

23. The computer-implemented method of claim 20, wherein operating the one or more artificial intelligence models to determine the one or more metrics comprises fitting the transport envelope of the load carried on the at least one railcar in a comparative fit to the clearance data on the one or more railway routes; and characterizing, based on the comparative fit, the one or more metrics for each of the one or more railway routes.

24. The computer-implemented method of claim 20, comprising operating the one or more artificial intelligence models to:

determine at least one second prediction that the one or more metrics for each of the one or more railway routes fails to meet a second criterion;

discover, in response to the at least one second prediction, at least one alternate railway route to meet the second criterion to replace at least the one or more railway routes; and generate the output information based on the at least one second prediction, the output information being further indicative of the at least one alternate railway route.

25. The computer-implemented method of claim 20, wherein operating the one or more artificial intelligence models comprises at least utilizing one or more of:

a first model trained to determine dimensions from image data and to calculate envelopes from the dimensions;

a second model trained to find optimal paths along the one or more railway routes; and a third model trained to predict clearance based on an analysis of the clearance data, the envelopes, and the optimal paths.

* * * * *